United States Patent [19]

Kamijo et al.

[11] Patent Number: 4,667,128

[45] Date of Patent: May 19, 1987

[54] TRANSPARENT ELECTRODE WITH PROTECTIVE, CONDUCTIVE GRID

[75] Inventors: Yoshimi Kamijo; Yoshinori Kato; Masami Ikarashi, all of Furukawa, Japan

[73] Assignee: Alps Electric Co., Ltd., Japan

[21] Appl. No.: 745,853

[22] Filed: Jun. 17, 1985

[30] Foreign Application Priority Data

Jun. 15, 1984 [JP] Japan ..... 59-121967

[51] Int. Cl.[4] ..... H01J 33/02; H01J 33/26

[52] U.S. Cl. ..... 313/505; 313/506

[58] Field of Search ..... 313/498, 505, 506, 509, 313/511, 355

[56] References Cited

U.S. PATENT DOCUMENTS 4,015,166 3/1977 Ohshima et al. ..... 313/505 X

*Primary Examiner*—Palmer C. DeMeo
*Assistant Examiner*—K. Wieder
*Attorney, Agent, or Firm*—Guy W. Shoup

[57] ABSTRACT

A transparent electrode for use in a dispersive type electroluminescent device or the like comprises a transparent substrate, a transparent electrode film on the substrate, and a number of closely spaced protective ridges continuous with each other on the electrode film.

10 Claims, 6 Drawing Figures

TRANSPARENT ELECTRODE WITH PROTECTIVE, CONDUCTIVE GRID

FIELD OF THE INVENTION

The present invention relates to a transparent electrode for use in a dispersive type electroluminescent device, membrane switch, touch panel, or the like.

BACKGROUND OF THE INVENTION

Some flexible transparent electrodes comprise a transparent substrate made of a polyester sheet and a transparent electrode film formed on one or each side of the substrate and made from $In_2O_3$, $SnO_2$, Au, Pd, or other material. The transparent electrode of this kind is vulnerable to external impact and its electrode film or films readily sustain flaws. Therefore, it is required to be treated carefully. Further, high degree of the transparency makes it difficult to check to see if flaws are present on the electrode film. In addition, if an electrode having flaws are mounted in a device as it is, the quality of the device will be poor.

A dispersive type electroluminescent device using a conventional electrode is shown in FIG. 1, where a bottom electrode 1 consists of a sheet of aluminum. A light-emitting layer 2 is formed on the electrode 1 and made from an organic binder, such as epoxy or cyanoethylated cellulose, in which a fluorescent powder is dispersed for light emission. A transparent electrode 7 is stuck to the layer 2. This electrode 7 comprises a transparent substrate 4, such as a polyester sheet, and a transparent electrode film 3 made from $In_2O_3$, $SnO_2$, Au, Pd, or other material. The film 3 is formed on one side of the substrate 4 by vacuum evaporation, sputtering, or other similar method. This electrode film 3 is quite thin, of the order of angstroms. Hence it readily substains flaws. Further, its high transparency renders it difficult to see if flaws are present. If the transparent electrode 7 has flaws, and if it is incorporated in a device as it is, the flawed portions will not emit light.

SUMMARY OF THE INVENTION

In view of the foregoing difficulties with the prior art technique, it is the main object of the present invention to provide a transparent electrode which does not readily sustain flaws.

The above object is achieved in accordance with the teachings of the present invention by a transparent electrode comprising a transparent substrate, a transparent electrode film formed on the substrate, and a number of closely spaced protective ridges continuous with one another on the film.

DETAILED DESCRIPTION OF THE INVENTION

Figure 1:
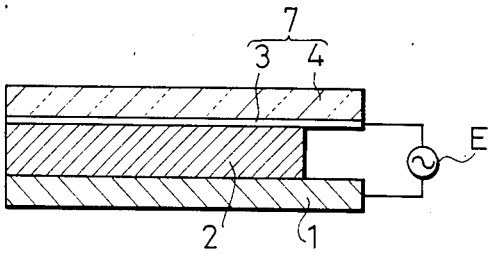
Fig.1 PRIOR ART
FIG. 1 is a cross-sectional view of an electroluminescent device using a conventional transparent electrode.
Figure 2:
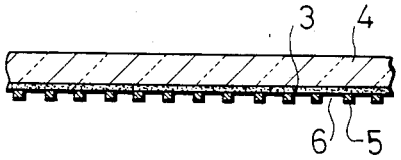
FIG. 2 is a cross-sectional view of a transparent electrode according to the present invention.
Figure 3:
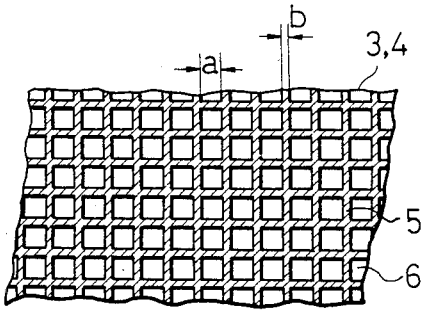
FIG. 3 is a bottom view of the electrode shown in FIG. 2.
Figure 4:
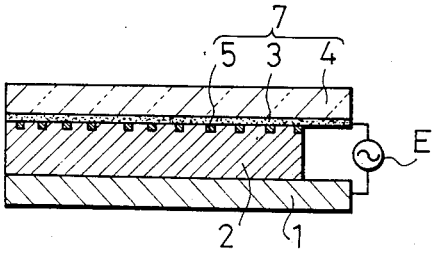
FIG. 4 is a cross-sectional view of an electroluminescent device using the electrode shown in FIGS. 2 and 3.

A transparent electrode according to the present invention is shown in FIGS. 2 and 3. A dispersive type electroluminescent device using this electrode is shown in FIG. 4. The transparent electrode comprises a transparent substrate 4 made of a polyester sheet or the like, a transparent electrode film 3 made from $In_2O_3$, $SnO_2$, Au, Pd, or other material and formed on one side of the substrate 4, and meshy, protective ridges 5 which are continuous with one another and have a thickness of about 1 to 30 μm. The ridges 5 are formed on the film 3 by screen printing.

Referring particularly to FIG. 3, both sides of each rectangular open space 6 between the protective ridges 5 should have a length a of about 100 to 300 μm. It is desired that the width b of the protective ridges 5 be about 10 to 50 μm. By setting the dimensions a and b within these ranges, the transparent electrode film 3 can be effectively prevented from sustaining flaws. Further, the characteristics including the light transmittance does not deteriorate so much. The shape of each open space 6 is not limited to a square. For example, it may be a rectangle or hexagon.

A light-emitting layer 2 is formed on a bottom electrode 1 made from aluminum. The aforementioned transparent electrode 7 is stuck to the layer 2 in such a way that the meshy protective ridges 5 are disposed opposite to the layer 2. The transparent electrode film 3 is exposed through the open spaces 6. Therefore, the electrode 7 can make close contact with the light-emitting layer 2, whereby the best use is made of the electroluminescence. Also shown is a power supply E.

EXAMPLE 1

The protective ridges 5 were made from an epoxy resin that could well adhere to the transparent electrode film 3. In particular, only an uncured epoxy resin having a good transparency was dissolved in an organic solvent prepared from petroleum to control the viscosity of the paint. This paint was deposited on the transparent electrode film 3 by screen printing and dried to form the closely spaced, meshy protective ridges 5.

EXAMPLE 2

The organic binder for the light-emitting layer 2 was cyanoethylated cellulose. Also, cyanoethylated cellulose was employed for the protective ridges 5. Since the same substance was used for them, the protective ridges 5 well adhered to the light-emitting layer 2.

EXAMPLE 3

A conductive fine powder whose particle size ranged from about 0.1 to 2 μm was uniformly mixed into the protective ridges 5. The fine powder was silver, transparent silicon dioxide, graphite, or other substance. By imparting electrically conductive property to the ridges 5 in this way, it was possible to correct for nonconducting portions due to flaws on the transparent electrode film 3. Further, reduction in the sheet resistance could be prevented.

EXAMPLE 4

An inorganic fine powder of $TiO_2$, $Al_2O_3$, $SiO_2$, or other substance was uniformly mixed into the protective ridges 5 to enhance the mechanical strength of the ridges 5.

EXAMPLE 5

Fine powder of a hygroscopic substance, such as zeolite, silica gel, molecular sieve, or calcium oxide. A life test under the conditions of 40° C., a relative humidity of 90 to 95%, 100 V, and 50 Hz showed that the hygroscopicity given to the ridges 5 resulted in a longer luminosity half-life of 2000 hours than the conventional luminosity half-life of 1500 hours.

Figure 5:
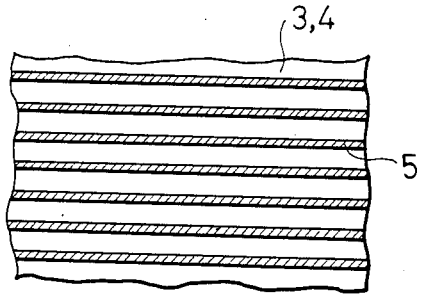
FIGS. 5 and 6 are plan views of other examples of protective ridges.
Figure 6:
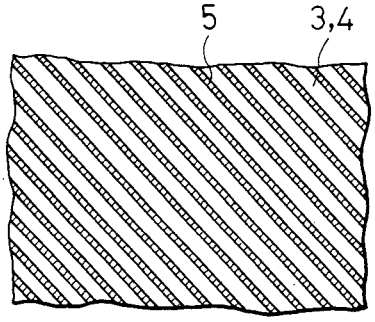

Other examples of the protective ridges 5 are shown in FIGS. 5 and 6. In the example of FIG. 5, a number of protective ridges 5 extend laterally in parallel relation to each other. In the example of FIG. 6, many protective ridges 5 extend obliquely in a parallel relation.

The protective ridges are not limited to these patterns. For example, a number of protective ridges may be disposed longitudinally in parallel relation to each other. Also, the protective ridges may be shaped into a wavy or honeycomb form.

Since the novel transparent electrode is constructed as thus far described, it is prevented from sustaining flaws during the manufacture. Hence, the quantity of the electrode is high.

What is claimed is:

1. A transparent electrode, to be used spaced apart in parallel with a second electrode, comprising a transparent substrate, a transparent electrically conductive electrode film formed on the substrate, said substrate and conductive film being formed as a continuous sheet extending over a defined area in which current is to be applied between said transparent electrode and the second electrode, and a protective, conductive layer including a number of closely spaced protective ridges which are continuous over said defined area and are applied on said transparent electrode film, whereby said protective, conductive layer protects said transparent electrode film from flaws, and maintains the conductivity of said electrode film in said defined area.

2. A transparent electrode as set forth in claim 1, wherein the protective ridges have been formed by screen printing.

3. A transparent electrode as set forth in claim 1, wherein the protective ridges are of meshy structure.

4. A transparent electrode as set forth in claim 3, wherein each open space between the ridges is a square whose both sides are about 100 to 300 μm in length, and wherein the ridges have a width of about 10 to 50 μm.

5. A transparent electrode as set forth in claim 1, wherein the protective ridges extend laterally in parallel relation to each other.

6. A transparent electrode as set forth in claim 1, wherein the protective ridges extend obliquely in parallel relation to each other.

7. A transparent electrode as set forth in claim 1, wherein the protective ridges contain a resin.

8. A transparent electrode as set forth in claim 1, wherein the protective ridges contain a conductive fine powder.

9. A transparent electrode as set forth in claim 1, wherein the protective ridges contain an inorganic fine powder.

10. A transparent electrode as set forth in claim 1, wherein the protective ridges contain a fine powder of a hygroscopic substance.

* * * * *